US005971848A

United States Patent [19]

Nair et al.

[11] Patent Number: 5,971,848

[45] Date of Patent: Oct. 26, 1999

[54] PLASTIC RIDGE VENT

[75] Inventors: Ravinder Nair, Warren; Edward C. Villela, Leonia, both of N.J.

[73] Assignee: Building Materials Corporation of America, Wayne, N.J.

[21] Appl. No.: 09/064,251

[22] Filed: Apr. 22, 1998

[51] Int. Cl.[6] ..... F24F 7/02

[52] U.S. Cl. ..... 454/365

[58] Field of Search ..... 454/365; 52/199, 52/57

[56] References Cited

U.S. PATENT DOCUMENTS

| | | | |
|---|---|---|---|
| 4,280,399 | 7/1981 | Cunning | 98/42 |
| 4,325,290 | 4/1982 | Wolfert | 98/42 |
| 4,676,147 | 6/1987 | Mankowski | 98/42.21 |
| 4,817,506 | 4/1989 | Cashman | 98/42.21 |
| 4,903,445 | 2/1990 | Mankowski | 52/199 |
| 5,092,225 | 3/1992 | Sells | 454/365 |
| 5,095,810 | 3/1992 | Robinson | 454/365 |
| 5,122,095 | 6/1992 | Wolfert | 454/365 |
| 5,457,920 | 10/1995 | Waltz | 52/199 |
| 5,458,538 | 10/1995 | MacLeod et al. | 454/365 |
| 5,651,734 | 7/1997 | Morris | 454/365 |

*Primary Examiner*—Harold Joyce
*Assistant Examiner*—Derek S. Boles
*Attorney, Agent, or Firm*—William J. Davis; Imre Balogh

[57] ABSTRACT

A roof ridge ventilator made of a flexible unitary plastic panel adjustable to the configuration of various roof pitches having: Z-shaped and Y-shaped supports spaced from and alternating each other supporting the panel over the roof; ventilation means of rows of vent slots and slats running longitudinally on the two sides of the panel in which the slots and slats have trapezoidal configurations; vertical exterior baffles integral with the vent slats and running parallel thereto; and baffle extenders integral with the exterior baffles and at an angle of from about 130° to about 160° from the plane of the vertical exterior baffles.

18 Claims, 7 Drawing Sheets

PLASTIC RIDGE VENT

BACKGROUND OF THE INVENTION

1. Field of the Invention

This invention relates to roof ridge ventilators. More particularly, the invention relates to plastic roof ridge ventilators comprised of a one-piece polymeric material having longitudinally oriented vent panels wherein the vent panels comprise alternating slots and slats each having a trapezoidal configuration.

2. Reported Developments

Ventilators for attics of buildings are perforated or baffled vent openings in the underside of the eaves of an overhanging roof or facia and on the roof ridge overlaying the open roof along the length of the roof. The vent openings allow outside air to flow into the attic to equalize the interior attic temperature and pressure with that of the outside environment. This equalization helps to prevent degradation of the roof structure, reduces the accumulation of condensation in the insulating material covering the floor of the attic thereby increasing the efficacy of heating/cooling of the living space in the building covered by the roof structure.

The ventilator system of the prior art is typically comprising: a roof ridge ventilator and a soffit ventilator. The roof ridge ventilator overlays the open roof along the length of the roof for exhausting the air from the space below the roof and the ceiling of the attic, i.e., as the air entering the attic through the soffit vent mixes with the warmer air in the attic, it has to be expelled through an opening in the roof ridge where the lighter, warmer air accumulates. Desirably, the volume of air intake through the soffit ventilator should be balanced by the volume of air exhaust through the roof ridge ventilator. In an optimum soffit ventilator/roof ridge ventilator system there is a balance between the net free open area presented by such system. The terminology "Net Free Open Area" or NFA means the cross-sectional area of a ventilator system which is open for passage of air therethrough. The appropriate balance of the net free open area of a soffit ventilator and roof ridge ventilator is imperative. Thus in many existing and newly built buildings there is a potential for an out of balance soffit/roof ridge ventilation system.

Ventilation systems should also provide against insects entering into the attic space of buildings. While large perforations in the soffit and roof ridge ventilation panels would render the desired flow of air through the attic space, they would also allow ingress to insects therein to form insect colonies.

In addition to having good ventilation of the attic space and preventing ingress of water, snow and insects into the attic space, the desiderata in a ventilation system includes: structural strength and stability to withstand the effects of the elements, such as high wind; strong structural support against collapse or warping, such as occurs by the accumulation of snow or ice or by the weight of the installers accidentally stepping on the roof ridge ventilator; easy handleability on installation; and low costs.

The present invention is directed to roof ridge ventilators which preferably are used in conjunction with an adequate soffit ventilator of the prior art.

Illustrative examples of the prior art directed to roof ridge ventilators are as follows.

U.S. Pat. No. 5,651,734 discloses a ridge cap roof ventilator applied in roll form comprising a corrugated plastic sheet material.

U.S. Pat. No. 4,676,147 relates to a roof ridge ventilator comprising: a one piece cover member including a pair of flaps and a hinge unitary with the flaps to allow for installing the ventilator on roof ridges of different angles. Vents are located under the flaps. The vents also have an interior baffle structure to deflect air flow and to limit entry of foreign particles through the roof ridge.

U.S. Pat. No. 4,280,399 discloses a roof ventilator comprising a corrugated plastic sheet material which may be mounted transversely across any roof ridge regardless of its contours or roof angles.

U.S. Pat. No. 5,457,920 discloses a ridge top vent for roofs which vent includes grill portions flexibly located longitudinally along the lateral edges. The grill portions have at their distal end a set of flexible teeth adapted to fit on shingles and down between shingles in the gaps therebetween, so as to prevent passages between the grills and the shingles of any debris, insects or vermin.

U.S. Pat. No. 4,817,506 discloses a roof vent which includes a sheet-like cover having an inverted V-shaped cross-section. A pair of baffles are disposed on the lower surface of the cover and include a plurality of spaced partitions for supporting the baffles rigidly against the cover.

U.S. Pat. No. 5,095,810 discloses a roof ridge ventilation system comprising: a ridge vent composed of two panel portions joined together and forming an inverted V-shaped configuration which fits over the peak of the roof. A plurality of V-shaped baffles support the panels. Ventilation ribs are included extending downwardly from each side of the panels to allow passage of air into and out of the openings in the roof. An angled flange is also provided on both sides of the ridge vent to deflect air upwardly and over the roof to create negative air pressure which in turn helps to exhaust stagnant air from the attic space.

U.S. Pat. No. 5,458,538 discloses a roof vent comprising a one-piece plastic body. A plurality of transverse supports are provided for the one-piece plastic body. The system includes a wall to deflect entry of snow and rain. There are also drain openings to allow moisture to escape.

Although the prior art has provided various ventilation systems to address the desiderata, we have found that the balance of the Net Free Open Area for a soffit ventilator and roof ridge ventilator is not always adequately achieved for the reason that the roof ridge ventilators do not allow the passage of sufficient amounts of attic air to pass therethrough while preventing entry of snow, rain, ice and insects.

We believe that the performance of such roof ridge ventilators may be improved by a baffle in which the rows of vent openings run longitudinally along the sides of the roof ridge ventilator panel. In preferred embodiments, the rows of individual slots and slats have a trapezoidal, rectangular or elliptical configuration. Other longitudinal configurations are possible.

SUMMARY OF THE INVENTION

The ridge vent of the present invention is designed to cover the opening at the peak of a roof to provide ventilation of the attic space while preventing entry of water, snow and insects thereinto. The ridge vent comprises a unitary plastic panel which is disposed over the ridge of the roof overlapping the opening as well as overlapping portions of the shingles adjacent to the opening. The panel is flexible and can be contoured to roofs having about 10° to 45° or more at the peak. The panel can be contoured at a central point line and at two parallel lines spaced from the central point line running longitudinally of the panel. The panel has a top face or surface facing the shingle and a bottom face or surface facing the attic space. The bottom surface is supported by Z-shaped and Y-shaped supports spaced from and alternating each other throughout the length of the panel.

Rows of vent slots and slats integral with the panel run longitudinally on the two sides of the panel to provide for ventilation. In a preferred embodiment, the individual slots and slats are of trapezoidal configuration having two parallel sides of different length. The longer length side of the slats faces the outside, while the longer length side of the slots faces the attic side. This configuration prevents entry of water, snow, ice and insect into the attic space while enhancing the flow of static air out of the attic space. Other longitudinal configurations, such as rectangular and elliptical configurations, are contemplated.

A vertical, solid exterior baffle integral with the rows of slots and slats and running parallel thereto on the two sides of the panel is provided to achieve the Bernoulli effect whereby, when the external wind impacts on the baffle, the wind is deflected towards the peak of the roof creating a vacuum over the rows of slots and slats. The exterior baffle extends into a baffle extender, and integral therewith, which is slightly higher than the height of the baffle extender and is at an angle of about 130° to about 160°, and preferably about 145° from the plane of the exterior baffle. The baffle extender further enhances the vacuum effect of the exterior baffle.

Gutters, integral with the rows of slats and the exterior baffle, lead water, which passes through drain holes built into the lowest row of the slats, towards one or the other end of the panel.

DETAILED DESCRIPTION OF THE INVENTION

Figure 1:
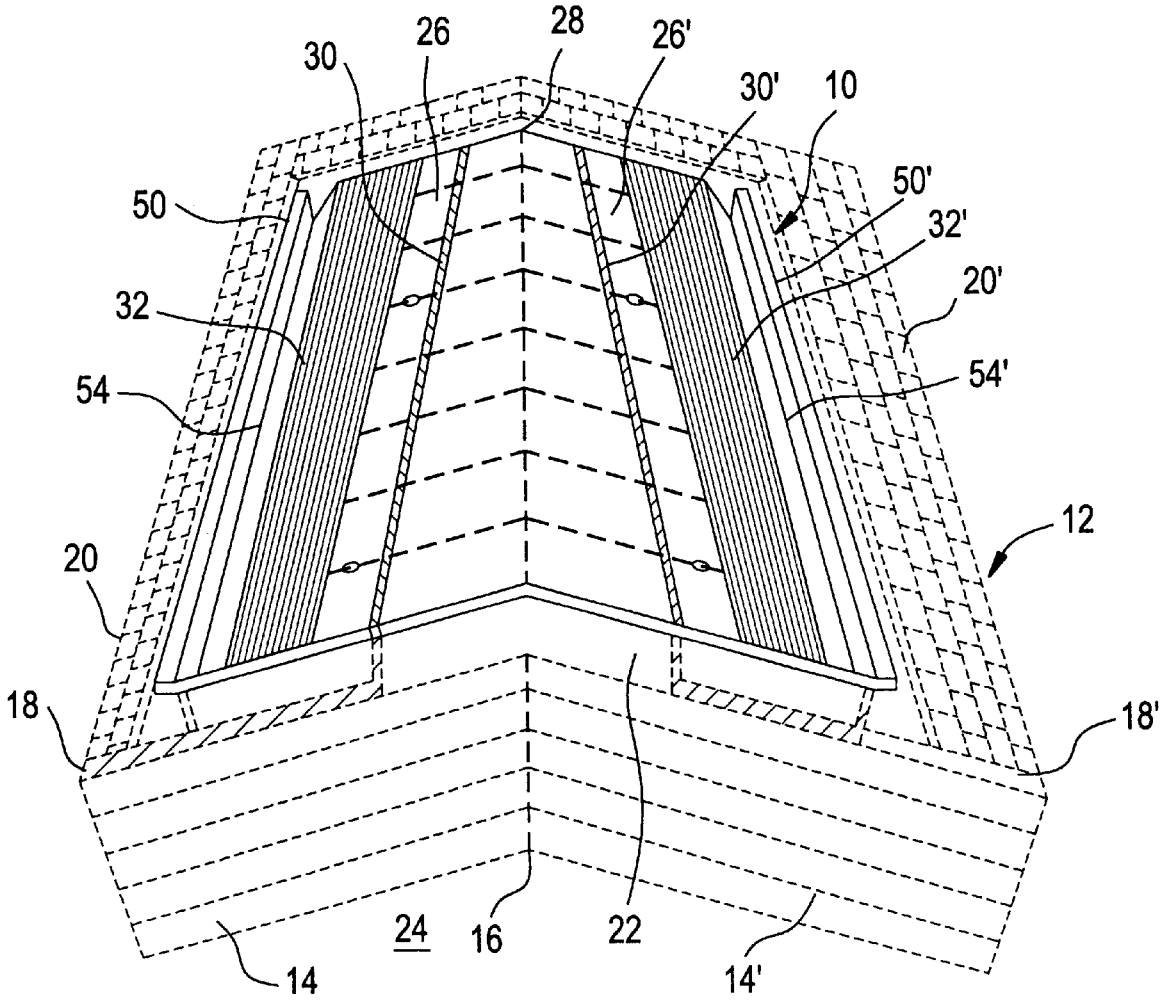
FIG. 1 is a perspective view of the plastic ridge vent of the present invention mounted on a section of a building roof.

FIG. 1 is a perspective view of the plastic ridge vent 10 mounted in a section of a building roof 12. Building roof 12 comprises: a plurality of cross-beams 14 and 14' joined together at 16 to form the structural support for building roof 12. Plywood decking 18 and 18' are laid over the cross-beams. The plywood decking is covered with shingles 20 and 20'. The plywood decking and covering shingles on the plywood decking do not completely cover the roof; at the ridge of the roof there is an opening or gap 22 which serves as an exit for air from the attic space 24. The gap exists between each pair of cross-beams defining a continuous space under the peak of the roof so that the attic air can be vented to the outside. While the gap would provide for maximum ventilation of the attic space, it would allow entry of rain, snow, insects and debris to enter into the attic space. To prevent such entry, as well-known in the art, a ridge ventilator covers the gap and at least partially overlaps the plywood deck and shingles of the roof. The overlap ensures that precipitation does not migrate toward the peak of the roof and enter the attic space.

The present inventive plastic ridge vent 10 covers the gap at the peak of the roof and provides for proper ventilation of attic space 24 while preventing entry of moisture, birds and insects thereinto without substantially affecting the maximum ventilating capability of the gap if left uncovered. This, and other aspects of the inventive plastic ridge will be explained as the description thereof follows.

The plastic ridge vent of the present invention comprises a unitary panel 26 which is disposed over the ridge of the roof. The panel is provided as a flat sheet material which is to be contoured to the configuration of the roof angle, which can be of about 10° to 45° or more since the plastic material of which the panel is made can be contoured to any desired angle on the roof. While the unitary construction is preferred, the panel may be constructed of two isometric panels joined together at the peak of the roof or other suitable means. The preference is for economy, and for the reason that semi-skilled workers will find it easier to install such a unitary panel and bend the same to the desired angle of the roof than joining two isometric panels and ensuring water impermeability between the joints of the two panels. Accordingly, the plastic ridge vent of the present invention is an initially flat sheet having top face 27 and bottom face 27'. The panel is bent at central point line 28 so that the panel conforms to the peak of the ridge. To obtain a smooth configuration, plastic ridge vent 10 may be bent not only at central point line 28 but also at linear point lies 30 and 30'.

Figure 2:
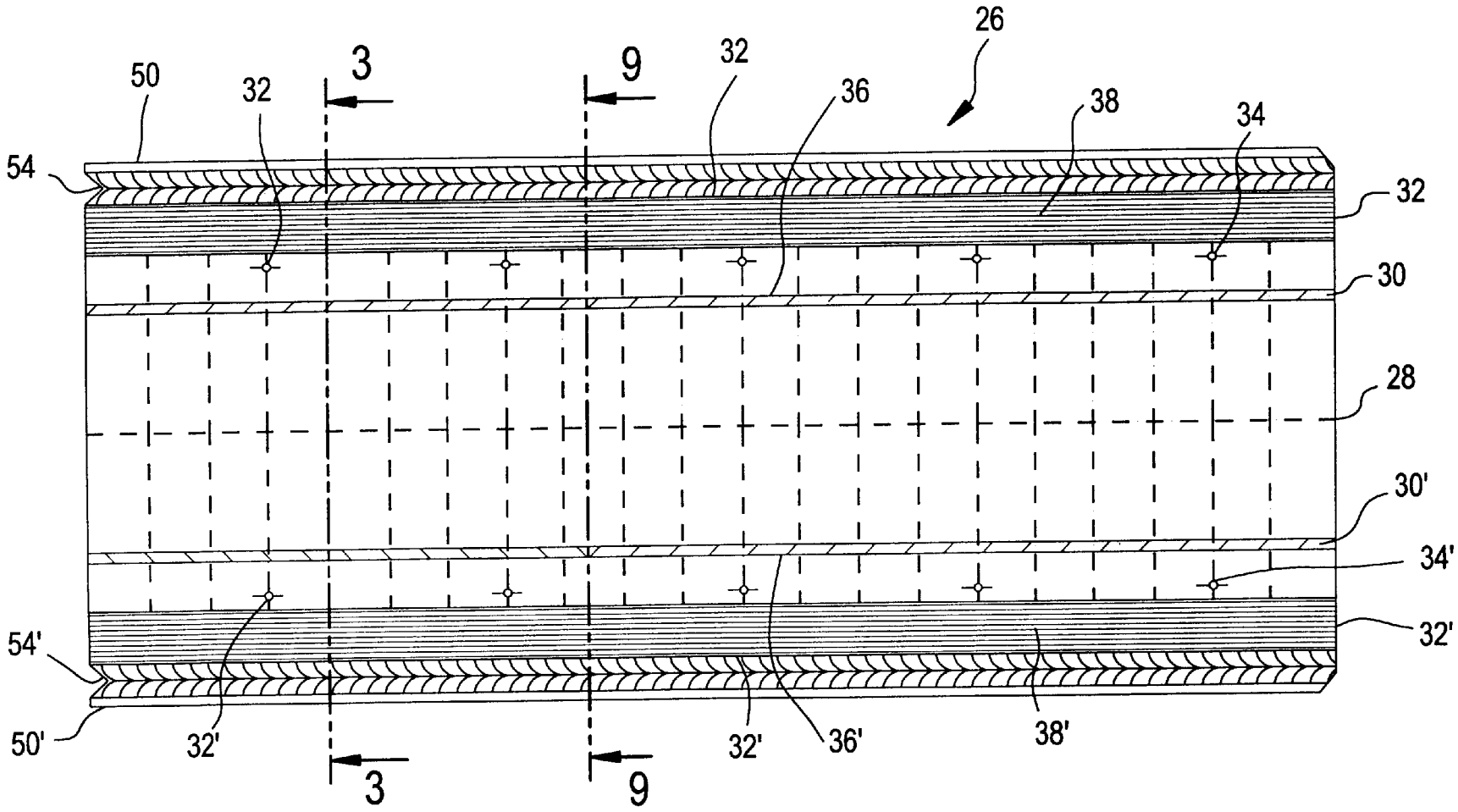
FIG. 2 is a top plan view of the plastic ridge vent shown in FIG. 1.
Figure 4:
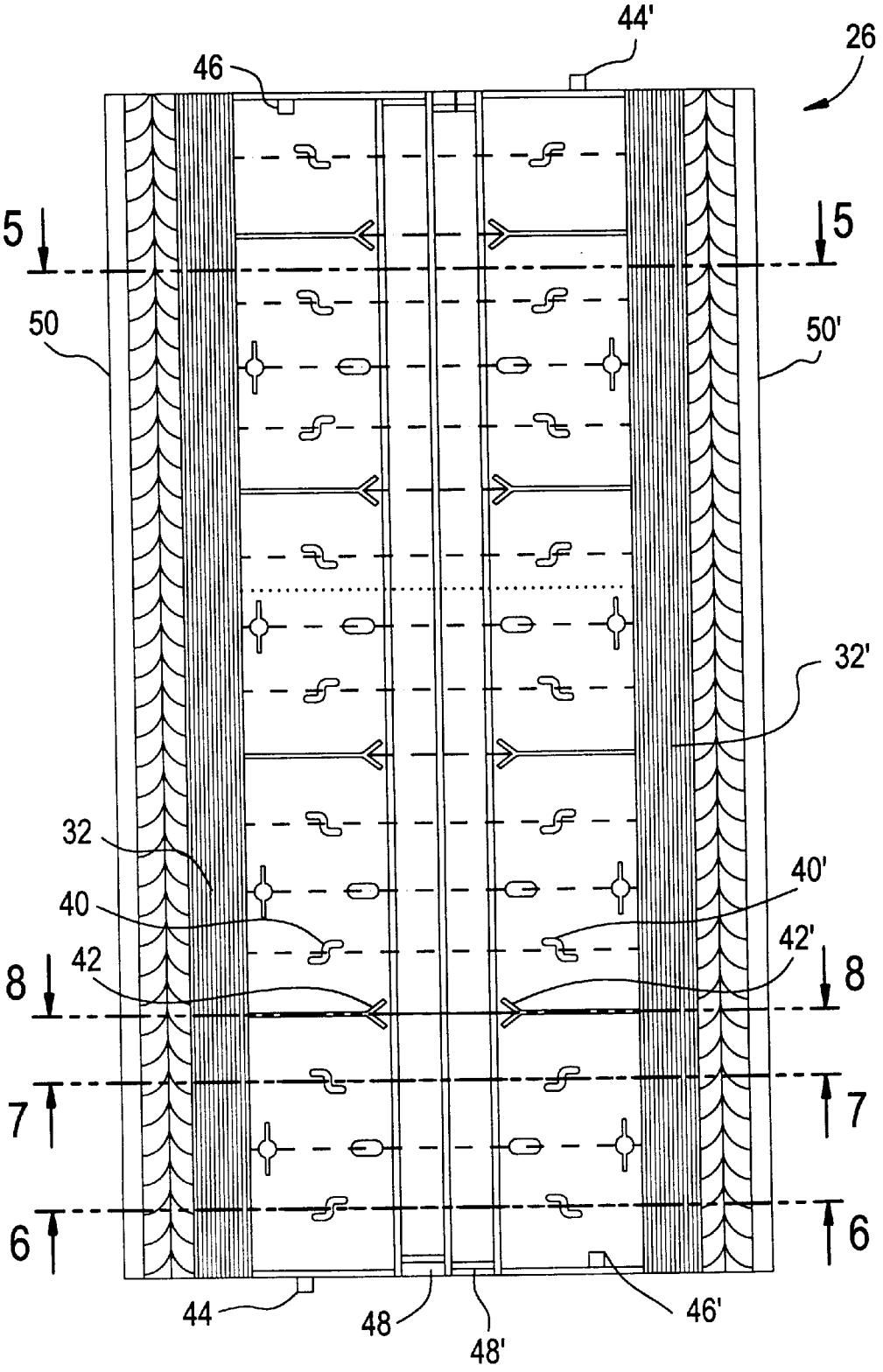
FIG. 4 is a bottom plan view of the plastic ridge vent shown in FIG. 1.

Panel 26 is shown in FIGS. 2 and 4 having a top surface and a bottom surface. Shown in FIG. 2 is the top of the panel facing the outside and illustrating the various portions and attributes thereof. Typically, the panel has a dimension of about 48" in length and about 15" in width. It embodies longitudinally oriented vent slots 32 and 32' which run through the entire length of the panel. A plurality of tack holes 34 and 34' are marked for facilitating installation, which run parallel to vent slots 32 and 32'. The tack holes are provided for initially positioning the panel over the roof ridge. Nail lines 36 and 36' serve to securely attach the panel to the roof using nails as final attachment means. Typically, linear point lines have a width of about 0.25" at which the panel is weakened allowing for easy flexibility so that the panel may conform to the underlying configuration of the roof structure. Drain slots 38 and 38' are spaced from each other at a distance of about 2".

FIG. 4 shows the bottom face or surface of panel 26 which surface faces the attic space and the roof to which the panel is secured. In the drawings the numerals 40 and 40' denote Z-shaped supports spaced at intervals to support panel 26. The Z-shaped supports are placed at about 4" from each other. In a panel having a length of 48", therefore, there are 12 Z-shaped supports. Panel 26 is further supported by Y-shaped gussets 42 and 42' positioned between each pair of Z-shaped supports. Y-shaped gussets are also spaced at about 4" from each other. In a panel having a length of 48", therefore, there are 12 Y-shaped gussets. As a result of spacing the Z-shaped supports and Y-shaped gussets as indicated, panel 26 is supported against the roof at every two-inch interval.

Panel 26 is provided with a pair of slots and pins at both end edges of the panel: one end edge has pin 44 and slot 46 while the other end edge has pin 44' and slot 46'. The pins and slots enable the positioning and connecting of one panel to the next panel during the installation process.

To prevent leakage between the joints of two panels, panel 26 is also provided with a pair of hinges 48 and 48'. The hinges at both end edges of the panel are designed to sealingly cover the joints between two adjacent panels at the center point line 28 and immediate area on each side thereof. This area running longitudinally of the panel covers the opening or gap 22 in the peak of the roof. An overhang extension can be provided on one end of the panel in order to help further seal adjacent panels and prevent leakage.

Figure 3:
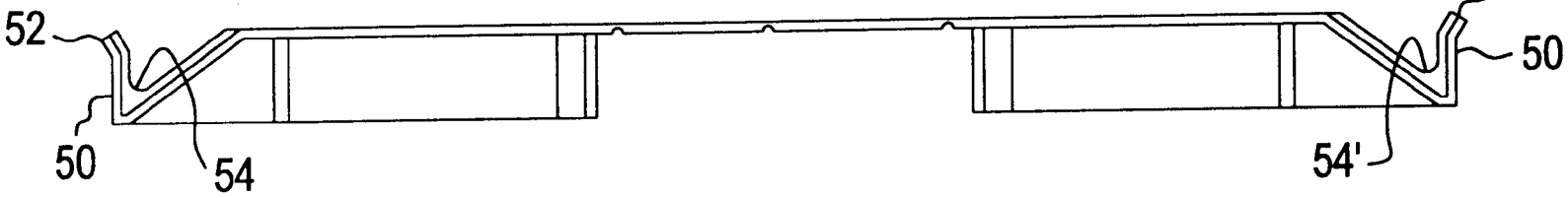
FIG. 3 is a cross-sectional view of the plastic ridge vent taken along the line of 3–3' of FIG. 2.

Vent slots 32 and 32' as shown in FIGS. 1, 3 and 4 run horizontally at the two longitudinal side of panel 26 in a plurality of rows to provide for ventilation and to prevent ingress of insects into the attic space. The number of rows may be of from about 2 to about 10. The total width of the rows is typically about 1.5" while the open width is about ⅛" between the rows.

Figure 5:
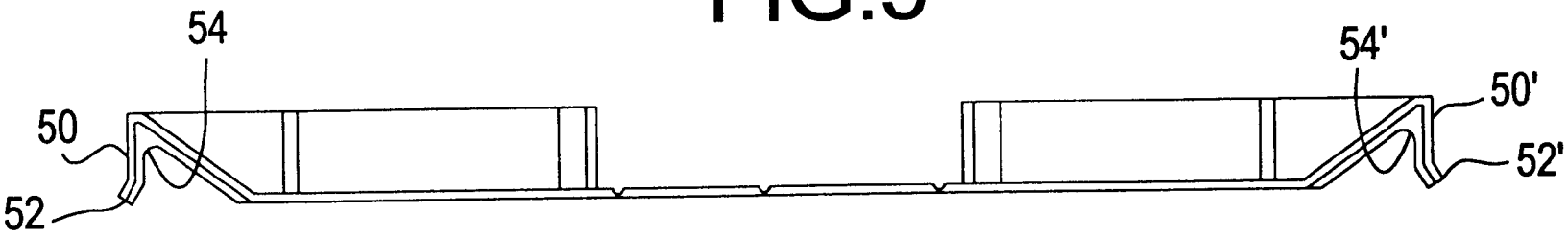
FIG. 5 is cross-sectional view of the plastic ridge vent taken along the line of 5–5' of FIG. 4.

Referring to FIGS. 1, 2, 3, 4 and 5, vertical exterior baffles 50 and 50' unitary with panel 26 and running longitudinally and parallel to vent slots 32 and 32' is provided for the purpose of inducing the Bernoulli effect. As the external wind impacts on the vertical wall, it will be deflected upward towards the peak of the roof. As the wind passes over the rows of vents it will create a vacuum drawing stagnant air out from the attic space. The height of the exterior baffles is typically about 0.8". In addition, the exterior baffles 50 and 50' may include baffle extenders 52 and 52' the heights of each of which is about ¼" and are at an angle of about 45° from the plane of the vertical baffles. The baffle extenders further improve the vacuum effect of the vertical exterior baffles. It is to be noted that vertical exterior baffles 50 and 50' and baffle extenders 52 and 52' in FIG. 5 are shown in a cross-sectional bottom view so that their orientation is opposite to those shown in FIGS. 1, 2, 3 and 4.

In FIGS. 1, 2 and 3 there are shown gutters 54 and 54' positioned between the plane of vent slots 32 and 32' and the plane of the vertical exterior baffles 50 and 50'. The plurality of drain slots 38 and 38' allow water to pass therethrough and collects in the gutters from which, in turn, the water runs down onto shingles 20 and 20'.

Reference is now being made to the supporting structure of the plastic ridge vent of the present invention As shown in FIG. 4, the bottom plan view of the plastic ridge vent, the support structure includes: a plurality of Z-shaped supports as denoted by 40 and 40'; a plurality of Y-shaped gussets as denoted by 42 and 42'; and nails in nail lines 36 and 36' located 2" from the edge of panel 26, excluding the venting section, on both sides of the ridge.

Figure 6:
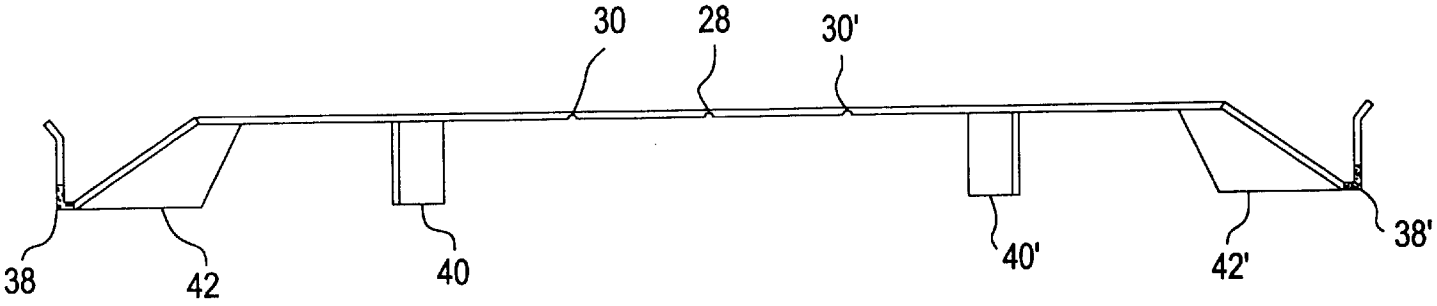
FIG. 6 is cross-sectional view of the plastic ridge vent taken along the line of 6–6' of FIG. 4.
Figure 7:
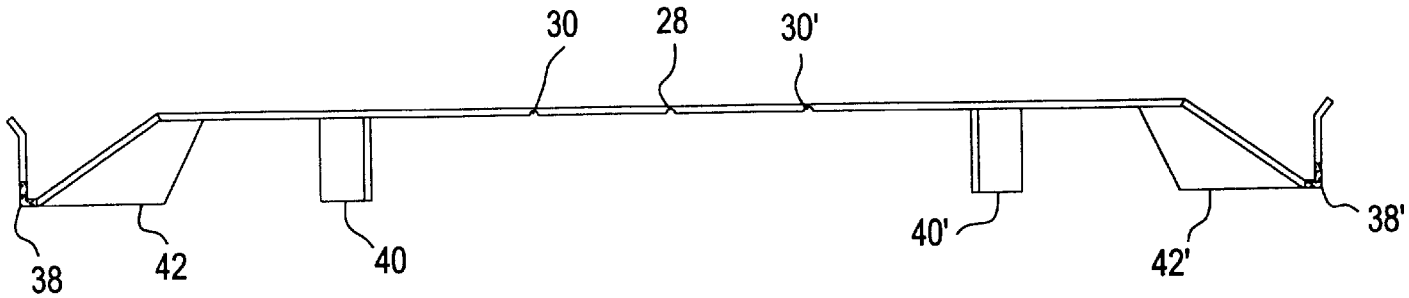
FIG. 7 is cross-sectional view of the plastic ridge vent taken along the line of 7–7' of FIG. 4.

FIGS. 6 and 7 show cross-sectional views of the plastic ridge vent taken along the lines 6—6 and 7—7 in FIG. 4 respectively. Z-shaped supports 40 and 40' are shown in FIG. 6 oriented towards the longitudinal edge of the ridge, while in FIG. 7 the Z-shaped supports 40 and 40' are oriented towards the center of the ridge.

Figure 8:
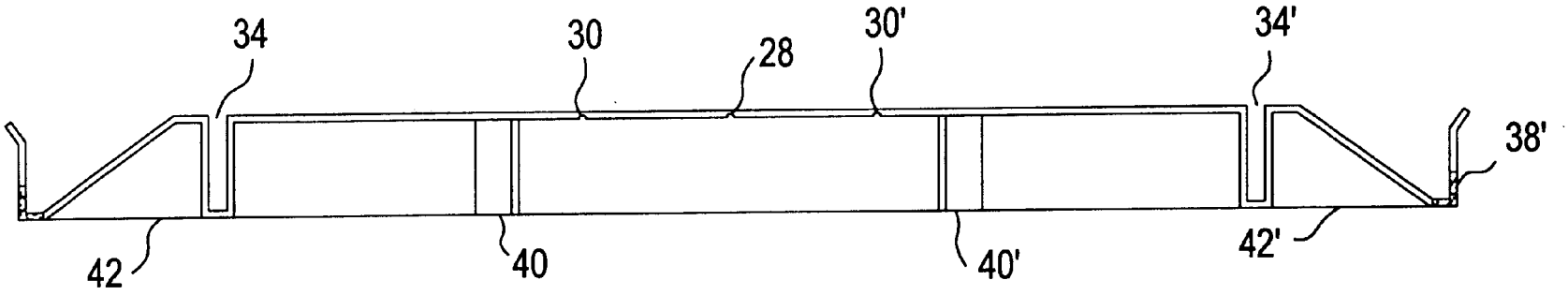
FIG. 8 is cross-sectional view of the plastic ridge vent taken along the line of 8–8' of FIG. 4.

FIG. 8 is a cross-sectional view of the plastic ridge vent, taken along the line 8—8' of FIG. 4, showing: Y-shaped gussets 42 and 42'; tack holes 34 and 34', and nail lines 30 and 30'. When installed, Y-shaped gussets, tacks positioned in tack holes and nails passed through the panel 26 at nail lines and into the underlying shingles 20 and 20' and plywood decking 18 and 18' provide for secure attachment of the plastic ridge vent of the present invention.

Figure 9:
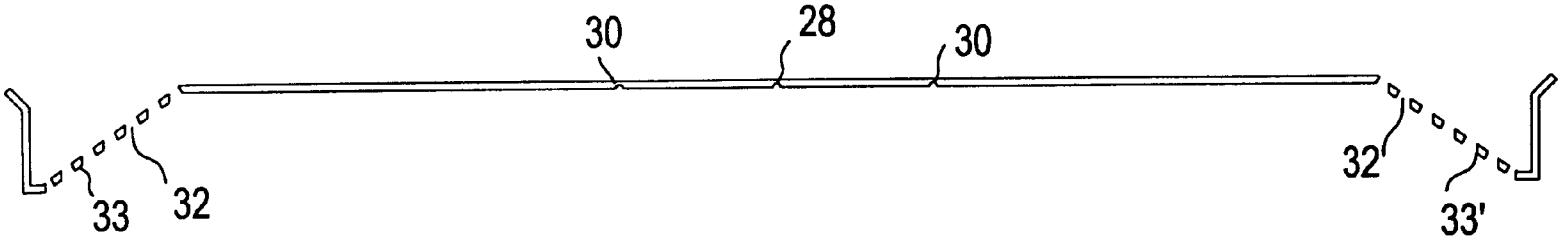
FIG. 9 is cross-sectional view of the plastic ridge vent showing the vent slots opening and vent slats and typical dimensions of the plastic ridge vent.

FIG. 9 is a cross-sectional view of the plastic ridge vent of the present invention taken along the line 9—9' of FIG. 2, but showing only the vent slots openings 32 and 32' and the vent slats 33 and 33' and typical dimensions of the plastic ridge vent. As shown the total width of the roof ridge vent including the vent slots, vent slats, vertical exterior baffles and baffle extenders is about 14.9". The width of the panel, not including the vent slots and vent slats, is about 11.6". The distance between the linear point line 30 and linear point line 30' is about 3.0". The height of the exterior baffle together with the baffle extender is about 1.0".

Figure 10:
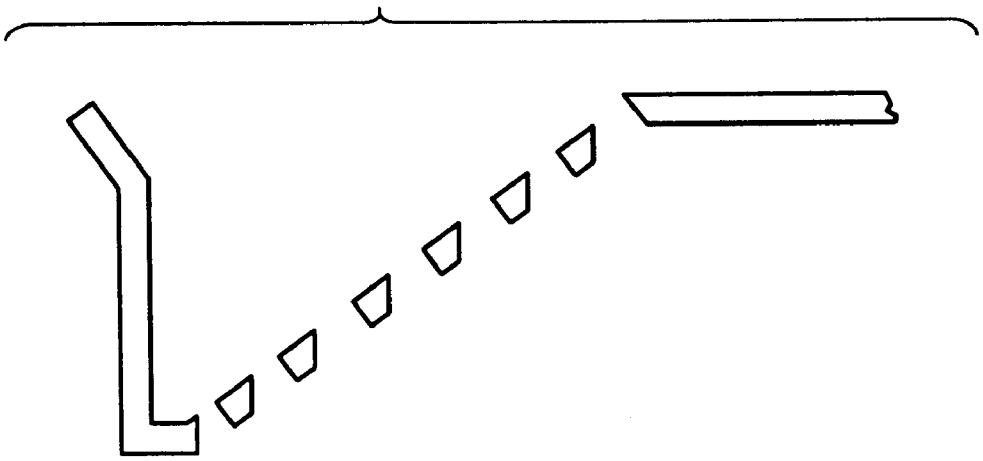
FIG. 10 shows the vent slots openings shown in FIG. 9.
Figure 11:
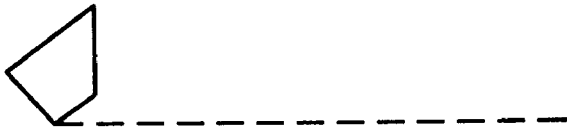
FIG. 11 shows the orientation of the vent slots along with typical dimension shown in FIG. 10.

Referring now to FIGS. 10 and 11 which show the main feature of the present invention, there are show 6 slots and 6 slats alternating and running longitudinally at the two side edges of the panel between the solid portion of the panel and the vertical exterior baffle. Each individual slat is oriented 90° from the horizontal plane and has a width of about 0.086" and a length along its longest side of about 0.125". The smallest dimension of the slot is also of about 0.125" which faces the outside environment. The side of the slot facing the attic side is larger. Both the slats and the slots are configured as trapezoidal, having two parallel sides and the other two sides being non-parallel to each other. While the longest side of the slats faces the outside, the longest side of the slots faces the attic side. As a result, snow, rain and insects are essentially prevented form entering through the slots and static warm air has a larger surface area in the underside of the vent to be expelled through the vent. The vacuum effect of the wind, which passes over the vertical exterior baffle and baffle extender, is greatly increased with the configuration of the slot/slat combination. As a results, warm air is more readily expelled from the attic space.

The ridge vent of the present invention may be manufactured from polymeric materials well-known in the building industry. Preferred polymeric materials include polyethylene, polypropylene and polyvinyl chloride and copolymers thereof. Recycled polymeric materials can be employed.

Having described the invention with reference to its preferred embodiments, it is to be understood that modifications within the scope of the invention will be apparent to those skilled in the art.

LIST OF PARTS

| | |
|---|---|
| Plastic ridge vent | 10 |
| Section of building roof | 12 |
| Cross-beams in building roof | 14 and 14' |
| Cross-beams joined together at peak | 16 |
| Plywood decking | 18 and 18' |
| Shingles | 20 and 20' |
| Opening or gap below the ridge of the roof | 22 |
| Attic space | 24 |
| Unitary panel | 26 |
| Top face or surface of panel | 27 |
| Bottom face or surface of panel | 27' |
| Central point line in panel | 28 |
| Linear point lines | 30 and 30' |
| Vent slots | 32 and 32' |
| Vent slats | 33 and 33' |
| Tack holes | 34 and 34' |
| Nail lines | 36 and 36' |

-continued

| LIST OF PARTS | |
|---|---|
| Drain slots | 38 and 38' |
| Z-shaped supports | 40 and 40' |
| Y-shaped gussets | 42 and 42' |
| Pins at end edges of panel | 44 and 44' |
| Slots at end edges of panel | 46 and 46' |
| Hinges at end edges of panel | 48 and 48' |
| Vertical exterior baffles | 50 and 50' |
| Baffle extenders | 52 and 52' |
| Gutters | 54 and 54' |

What is claimed is:

1. In a roof ridge ventilator for covering the ridge of the roof, having an opening therein for allowing ventilation of static air form an attic space of a building, adjustable to accommodate a variety of roof pitches and directs the flow of static air from the attic space to the outside environment comprising:

a unitary panel of plastic material having a length and a width and top and bottom faces and being flexible in a lateral direction so as to be adjustable to the configuration of the roof;

support structures in the bottom face of said unitary panel to prevent collapse or warping over said roof;

ventilation means for guiding air from the attic space to the exterior; and means for creating a vacuum over said ventilation means to enhance flow of static air from the attic space;

wherein the improvement comprises:

rows of vent slots and slats integral with said panel running longitudinally on two sides of the length of said panel; and two vertical exterior baffles integral with said rows of said vent slats and running parallel thereto to create a vacuum over the rows of slots and slats.

2. The roof ridge ventilator of claim 1 wherein said slots and slats are of trapezoidal configuration having two parallel sides of different length in which the longer length of the slats faces the outside while the longer length of the slots faces the attic space for guiding air from the attic space to the exterior.

3. The roof ridge ventilator of claim 1 wherein said vertical exterior baffles extend into baffle extenders and integral therewith which baffle extenders are slightly higher than the height of the baffles and each of which is at an angle of from about 130° to about 160° from the plain of the vertical exterior baffle.

4. The roof ridge ventilator of claim 3 wherein each of said baffle extenders is at an angle of about 145° from the plane of the exterior baffle.

5. The roof ridge ventilator of claim 1 wherein there are 3 to 10 rows of slots and slats.

6. The roof ridge ventilator of claim 2 wherein each slat is oriented 90° from the horizontal plane, has a width of about 0.074"–0.63" and a length at its longest side of about 0.074"–0.63", and wherein each slot has a length at its shortest side, facing the outside, of about 0.074"–0.63', and has a length at its longest side of at least 0.074"–0.63".

7. The roof ridge ventilator of claim 1 further comprising drain slots in said ventilation means.

8. The roof ridge ventilator of claim 1 further comprising a pair of hinges at both end edges of said panel and a pair of slots and pins at both end edges of said panel to sealingly attach one panel to the next panel upon installation of the roof ridge ventilator.

9. The roof ridge ventilator of claim 1 made of polymeric material.

10. The roof ridge material of claim 9 wherein said polymeric material is selected form the group consisting of polyethylene, polypropylene and polyvinyl chloride and copolymers thereof.

11. A roof ridge ventilator designed to cover the opening at the peak of a roof to provide ventilation of the attic space of the building, adjustable to accommodate a variety of roof pitches and directs the flow of static air from the attic space to the outside environment comprising:

a unitary panel of plastic material having a length and a width and top and bottom faces and being flexible in a lateral direction so as to be adjustable to the configuration of the roof;

support braces spaced throughout the length of the panel supporting the panel at the bottom face to prevent collapse or warping over said roof thereof;

ventilation means for guiding air from the attic space to the exterior comprising:

rows of vent slots and slats integral with said panel running longitudinally on two sides of the length of said panel, said slots and slats being of trapezoidal configuration having two parallel sides of different length in which the longer length of the slats faces the outside while the longer length of the slots faces the attic space for guiding air from the attic space to the exterior;

vertical exterior baffles integral with the rows of slats and running parallel thereto on both sides of the panel and extending into baffle extenders, said baffle extenders being integral with said baffles, are slightly higher than the height of the baffles and each of which is at an angle of from about 130° to about 160° from the plain of the vertical exterior baffle; and gutters integral with the rows of slats and the exterior baffles to lead water away from under the rows of slats and slots.

12. The roof ridge ventilator of claim 11 wherein said support braces are Z-shaped and Y-shaped.

13. The roof ridge ventilator of claim 11 wherein each of said baffle extenders is at an angle of about 145° from the plain of the exterior baffle.

14. The roof ridge ventilator of claim 11 further comprising drain slots in said ventilation means.

15. The roof ridge ventilator of claim 11 further comprising a pair of hinges at both end edges of said panel and a pair of slots and pins at both end edges of said panel to sealingly attach one panel to the next panel upon installation of the roof ridge ventilator.

16. The roof ridge ventilator of claim 11 made of polymeric material.

17. The roof ridge ventilator of claim 16 wherein said polymeric material is selected from the group consisting of polyethylene, polypropylene and polyvinyl chloride copolymers thereof.

18. The roof ridge ventilator of claim 11 wherein said panel is contoured at a central point line running longitudinally of the panel.

* * * * *